US010100669B2

(12) United States Patent
Farkas et al.

(10) Patent No.: US 10,100,669 B2
(45) Date of Patent: Oct. 16, 2018

(54) TURBO MACHINE AND METHOD FOR OPERATING SUCH TURBO MACHINE

(71) Applicant: ANSALDO ENERGIA IP UK LIMITED, London (GB)

(72) Inventors: Janos Farkas, Dietikon (CH); Giovanni Cataldi, Zurich (CH); Matteo Rocchi, Baden (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 165 days.

(21) Appl. No.: 14/887,834

(22) Filed: Oct. 20, 2015

(65) Prior Publication Data

US 2016/0108756 A1 Apr. 21, 2016

(30) Foreign Application Priority Data

Oct. 20, 2014 (EP) ..... 14189584

(51) Int. Cl.

| | |
|---|---|
| ***F01D 25/14*** | (2006.01) |
| ***F01D 11/24*** | (2006.01) |
| ***F01D 5/18*** | (2006.01) |
| *F01D 25/26* | (2006.01) |
| *F01D 25/10* | (2006.01) |

(52) U.S. Cl.

CPC ..... *F01D 25/14* (2013.01); *F01D 5/18* (2013.01); *F01D 11/24* (2013.01); *F01D 25/10* (2013.01); *F01D 25/26* (2013.01); *F05D 2270/094* (2013.01)

(58) Field of Classification Search

CPC ..... F01D 25/10; F01D 25/14; F01D 25/145; F01D 11/24; F01D 25/26; F01D 5/18; F05D 2270/094; F02C 6/003; F02C 7/24; F04D 29/584; F04D 29/5853

See application file for complete search history.

(56) References Cited

U.S. PATENT DOCUMENTS 4,482,293 A * 11/1984 Perry ..... F01D 11/24 415/113
6,220,814 B1 4/2001 Brushwood et al.

(Continued)

FOREIGN PATENT DOCUMENTS

CN 101782001 A 7/2010
CN 201661321 U 12/2010

(Continued)

OTHER PUBLICATIONS

The extended European Search Report dated Mar. 11, 2016, by the European Patent Office in corresponding European Application No. 15189111.6. (6 pages).

(Continued)

*Primary Examiner* — Logan Kraft
*Assistant Examiner* — Peter T Hrubiec
(74) *Attorney, Agent, or Firm* — Buchanan Ingersoll & Rooney PC

(57) ABSTRACT

A turbo machine, such as a gas turbine, includes a rotor, which rotates about a horizontal machine axis, and which is enclosed by a coaxial enclosure. The turbo machine includes a metal casing, whereby an electrical heating system is provided on the lower half of the metal casing. A safe operation is achieved by having the heating system configured as a redundant system.

14 Claims, 4 Drawing Sheets

(56) References Cited

U.S. PATENT DOCUMENTS

| | | | | |
|---|---|---|---|---|
| 2004/0120809 | A1 | 6/2004 | Loftus | |
| 2012/0167584 | A1* | 7/2012 | Philippot | F01D 11/24 60/778 |
| 2013/0236300 | A1 | 9/2013 | Hiller et al. | |
| 2014/0193237 | A1 | 7/2014 | Reiter et al. | |

FOREIGN PATENT DOCUMENTS

| | | | |
|---|---|---|---|
| EP | 2 639 411 | A1 | 9/2013 |
| EP | 2 754 859 | A1 | 7/2014 |
| WO | WO 00/04278 | A1 | 1/2000 |

OTHER PUBLICATIONS

European Search Report for EP 14189584.7 dated Apr. 23, 2015 (5 pages).

* cited by examiner

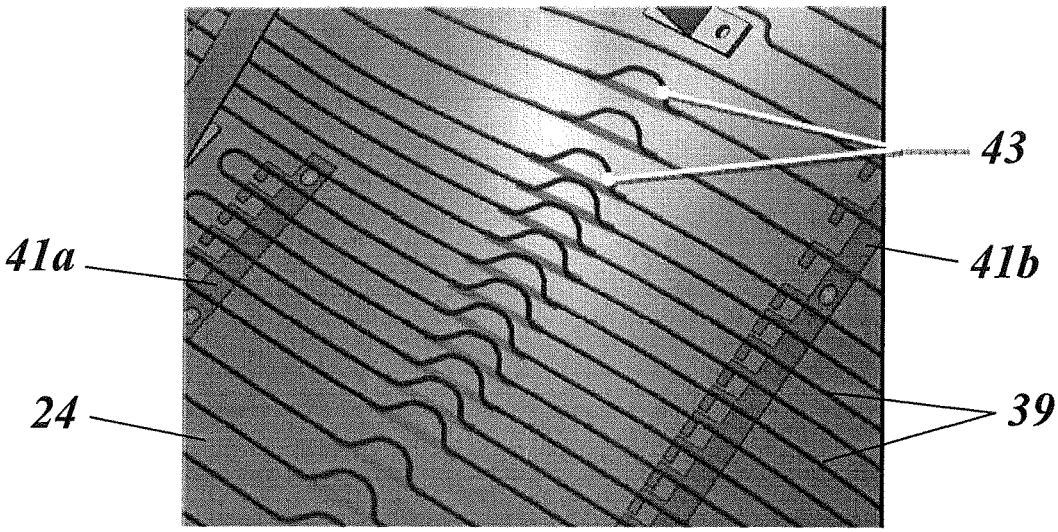
Fig.6
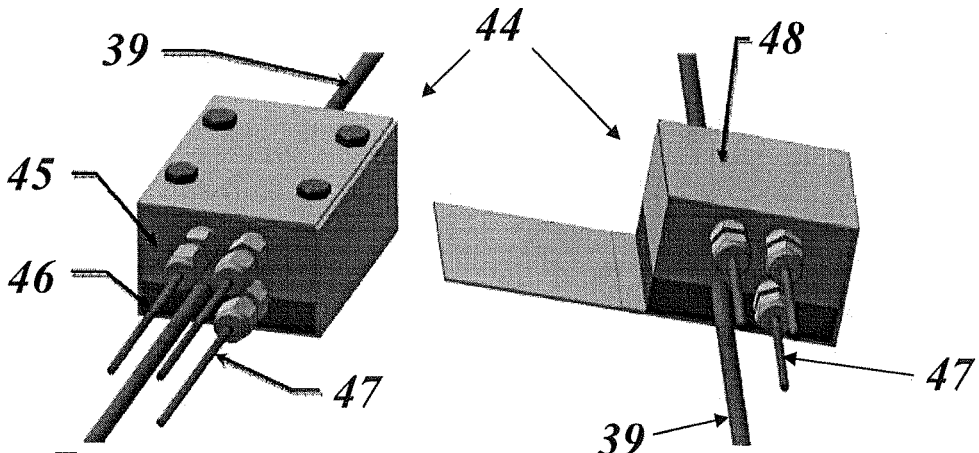
Fig.7a
Fig.7b

TURBO MACHINE AND METHOD FOR OPERATING SUCH TURBO MACHINE

BACKGROUND OF THE INVENTION

The present invention relates to the technology of turbo machines. It refers to a turbo machine according to the preamble of claim 1.

It further refers to a method for operating such a turbo machine.

PRIOR ART

FIG. 1 shows in a perspective view an example of a turbo machine in form of a gas turbine of the applicant of type GT24 or GT26. The gas turbine 10 of FIG. 1 comprises a rotor 11 rotating about a machine axis 20 and being enclosed by an (inner) casing 12. Arranged along the machine axis 20 gas turbine 10 comprises an air intake 13, a compressor 14, a first combustor 15, a first, high pressure (HP) turbine 16, a second combustor 17, a second, low pressure (LP) turbine 18 and an exhaust gas outlet 19.

In operation, air enters the machine through air intake 13, is compressed by compressor 14, and is fed to first combustor 15 to be used to burn a fuel. The resulting hot gas drives HP turbine 16. As it still contains air, it is then reheated by means of second combustor 17, where fuel is injected into the hot gas stream. The reheated hot gas then drives LP turbine 18 and leaves the machine at exhaust gas outlet 19.

The axial mass flow through such a turbo machine during full speed operation is very high. This high mass flow determines the temperature distribution in the casing which in turn—if the cooling air flows and the casing geometry is symmetric enough—is axisymmetric.

When the engine is turned off, it begins to decelerate; thus the mass flows inside decrease as well. At low axial mass flows, natural convection becomes a major contributor to the temperature distribution of the engine. Typically the bottom of the casing begins to cool down faster than its top.

In a gas turbine the outlet opens towards a stack that discharges air to the ambient. The phenomenon in this case is mostly due to the natural layering of the air flow inside the engine. Another example is the cool down of a steam turbine the outlet of which is open to a condenser. For such a turbo machine the inner casings are typically much hotter than the outer casings, which effect induces natural convection of the air between the two casings.

Both cases lead to an engine with higher casing metal temperatures on the top than on the bottom. Because of the temperature difference, the thermal expansion on the top and on the bottom is also different, leading to a casing bending upwards with respect to its axis. For example, the extent of the bending of a turbo machine with ~10 m distance between its bearings can be up to 1 mm or more.

Casing bending leads to non-axisymmetric radial clearances between the rotating and static parts, reducing the clearances locally between the rotor blades and the stator, as well as between the stator vanes and the rotor. When the casing bends upwards, the clearances on the top are enlarged while the clearances on the bottom are reduced. This can lead to rotor blocking and subsequent rotor deformation. Restarting the bent engine can result in blade/vane rubbing, smearing of the blade/vane material, crack initiation in the blades/vanes and potentially lifetime and performance reduction of the turbo machine.

The inner casings and the bearing housings are mechanically coupled to the outer casings, thus they tilt when the casing is bent. This increases the risk of rubbing and rotor blocking at the inner casings and especially inside the bearing where the slope of the outer casing is far from being horizontal. The bearings are very sensitive to tilting as typically they are operated with very low clearances on the bottom (i.e. very thin, ~0.1 mm bearing oil thickness).

Thus, the problems encountered can be summarized as follows:

- During the cool-down phase of gas turbines and of steam turbines or other turbo machines, it occurs that the bottom half of the outer casings loses heat faster than the top half. This is due to various physical phenomena that are all at the very end linked to the fact that, due to gravity, in a quasi stagnating or slowly moving flow, the colder portion tends to move and stratify downwards, while the hotter portion of the flow tends to stratify in the top half.
- The above leads to a differential thermal expansion between upper half and lower half of the casing, which in turn leads to an upwards bending of the casing with respect to the GT axis.
- Due to such upwards casing bending, the radial clearance between blades/vanes and casings and inside the bearings in the bottom half of the machine gets tighter.
- Due to the thermal inertia of the casing and due to the fast start transient of modern turbo machines, during a restart there is not enough time for the casing to get straight again.
- The final consequence is a rubbing in the bottom part and a consequent loss of part life and/or machine performance.

Existing solutions to solve this problem are all either ineffective or cost intensive.

- Outer insulation with different thickness between top half and bottom half→ineffective over the long cool-down period transients towards a warm restart of the machine (when the issue is typically at its worst point)
- Casing Mantling Air System (CMAS), mainly applied to GTs→effective in keeping uniform temperature during cool-down, but cost and space intensive; the system also has the issue of overcooling the top half of the casing during a warm restart, thus leading to a downwards bending
- SEV Cavity Ventilation (ventilating of the casing air moving it from bottom to top or vice versa, by using an external pipe and fan or high pressure injector)→very cost intensive, several issues linked to the isolation of the pipe and of the fan during normal operation.
- Active Clearance Control systems (shifting of the rotor or opening and closing the casings by means of external steam supply)→the approach can be seen as a mitigation to go around this problem, although it does not address it directly; the drawback of the approach is that it is effective only on few stages of the turbo machine, thus it leads to minor performance benefit with respect to the specific casing bending issue.

In a different approach, document CN 101782001 A discloses a lower-half cylinder temperature compensation device of a cylinder, which mainly comprises an electric heating tube, wherein the electric heating tube is fixedly arranged on the outer side of the lower-half cylinder of the cylinder, and a heat insulation layer is arranged outside the electric heating tube. It also discloses a temperature compensation method for the lower-half cylinder temperature compensation device of the cylinder and adopts the electric heating tube for heating, whereby a closed-loop control is performed on the electric heating tube by detecting the temperature of an upper cylinder and a lower cylinder and taking the temperature difference of the upper cylinder and the lower cylinder as a control signal, and the electric heating tube is used for heating the lower-half cylinder of the cylinder so as to reduce the temperature difference of the upper cylinder and the lower cylinder and realize temperature compensation. The lower-half cylinder temperature compensation device of the cylinder and the temperature compensation method thereof can perform comprehensive heating on the lower-half cylinder of the cylinder, and the heating is evener, so the temperature difference phenomena of the upper cylinder and the lower cylinder of the cylinder can be eliminated effectively, various running problems caused by the phenomena in the past are solved, and the safe operation of a steam turbine is ensured.

Corresponding document CN 201661321 U discloses a lower-half cylinder temperature compensating device which mainly comprises an electric heating pipe fixedly arranged at the outer side of a lower-half cylinder. A heat-preservation layer is arranged outside the electric heating pipe. The electric heating pipe can be easily controlled, has good heating effect, and can effectively heat the lower-half cylinder so as to eliminate the temperature difference of upper/lower-half cylinders. A temperature measuring element can be a thermocouple, a platinum resistor, a copper resistor, a heat-sensitive resistor and the like. The lower-half cylinder temperature compensating device can heat the lower-half cylinder in an all-round manner, and the heating is more uniform; by carrying out good closed-loop control on the detection of the temperature difference of the upper/lower-half cylinders, the lower-half cylinder temperature compensating device can effectively eliminate the temperature difference of the upper/lower-half cylinders, so as to avoid various running problems caused by the temperature difference, thereby ensuring safety running of a steam turbine.

However, both systems use a plurality of fixed (standard) 2-dimensional heating modules, which on one hand are difficult to adapt to the complicated external geometry of the turbo machine casing and on the other hand result in substantial variations in the temperature distribution when one of these modules fails to operate.

SUMMARY OF THE INVENTION

It is an object of the present invention to provide a turbo machine, which avoids the disadvantages of known solutions and especially guarantees an equalized temperature distribution even in a case when some of the heating elements fail.

It is another object of the present invention to teach a method for operating such a turbo machine.

These and other objects are obtained by a turbo machine according to claim 1 and a method according to one of the claims 11, 12, 13 and 14.

The turbo machine according to the invention, which may especially be a gas turbine, comprises a rotor, which rotates about a horizontal machine axis, and which is enclosed by a coaxial enclosure comprising a metal casing, whereby an electrical heating system is provided on the lower half of said metal casing, whereby said heating system is configured as a redundant system. The turbo machine can also be steam turbine of a compressor.

According to an embodiment of the invention said heating system comprises at least one electrical heating module with two similar redundant lines running in parallel alongside each other.

Specifically, said at least one heating module is connected to a power supply unit such that either each of said redundant lines is supplied with 50% of the electrical power supplied to said heating module from the power supply unit or only one of said redundant lines is supplied with 100% of said electrical power.

According to another embodiment of the invention said heating system comprises measuring means for measuring temperatures and/or electrical properties within said heating system, and that said measuring means is configured as a redundant measuring means.

Specifically, said heating system comprises at least one heating cable, which is attached to said metal casing, and that said measuring means comprises at least one thermocouple box attached to said at least one heating cable to measure a temperature of said at least one heating cable.

More specifically, said at least one thermocouple box encloses a section of said at least one heating cable at a predetermined place of said at least one heating cable, that said at least one heating cable runs through said thermocouple box between an upper part and a lower part of said thermocouple box, and that at least three thermocouples for measuring the temperature of said thermocouple box are attached to said thermocouple box.

Moreover, said at least one thermocouple box may be covered with a thermal insulation in order to increase the temperature of the thermocouple box.

According to a further embodiment of the invention said heating system comprises at least one heating cable, which is attached to said metal casing by means of metal holding strips.

Specifically, said metal holding strips are placed between said metal casing and said at least one heating cable and hold said heating cable by means of hook elements.

More specifically, said at least one heating cable is provided with a bend between two distant holdings strips holding said heating cable.

According to just another embodiment of the invention a plurality of heating modules are symmetrically arranged on said metal casing with regard to a vertical symmetry plane through the machine axis, and that said heating modules are individually and controllably supplied with electric power by means of a power supply unit.

A method for operating a turbo machine according to the invention is characterized in that a control unit within said heating system decides on the electrical power supplied to said heating system based on measurements of the temperature of the metal casing and/or the clearance of the machine and/or electric parameters of the heating system and/or operating parameters of the machine.

Another method for operating a turbo machine according to the invention equipped with at least one thermocouple box with three thermocouples around a heating cable is characterized in that said at least one thermocouple box creates an artificial hot spot at said heating cable, and that said three thermocouples attached to said thermocouple box are evaluated by a control unit 33 with a 2-out-of-3 logic.

Another method for operating a turbo machine according to the invention with symmetrically arranged heating modules on both sides of a vertical symmetry plane is characterized in that a heating module on one side of said vertical symmetry plane is turned off, when its symmetric counterpart on the other side of said vertical symmetry plane fails.

Another method for operating a turbo machine according to the invention with symmetrically arranged heating modules on both sides of a vertical symmetry plane is characterized in that in case of an asymmetric cool-down with respect to said vertical symmetry plane the heating system is powered asymmetrically to counter said temperature asymmetry.

BRIEF DESCRIPTION OF THE DRAWINGS

The present invention is now to be explained more closely by means of different embodiments and with reference to the attached drawings.

FIG. 6 shows measures for absorbing thermal expansion of the heating cables according to an embodiment of the invention; and FIGS. 7*a* and 7*b* show an example of thermocouple boxes for overheating protection of the heating cables according to an embodiment of the invention.

DETAILED DESCRIPTION OF DIFFERENT EMBODIMENTS OF THE INVENTION

The invention described in this patent mitigates the issues caused by upwards thermal bending of a turbo machine casing which is caused by temperature differences forming during the engine's slow cool-down period. Thus it solves rubbing and rotor blocking issues both at the blades/vanes and at the bearings.

The invention is a trace heating system applied on a part of the bottom of a turbo machine casing. The system consists of resistive heating cables with the associated electronics, measurement and control devices.

The system can be used in two ways:

- preventive mode: turns on after shutdown when the bottom becomes colder than the top, to prevent casing bending during cool-down,
- Counteracting mode: turns on after rotor blocking is anticipated (e.g. when the rotor barring speed drops or when the roller shutter is closed).

Figure 2:
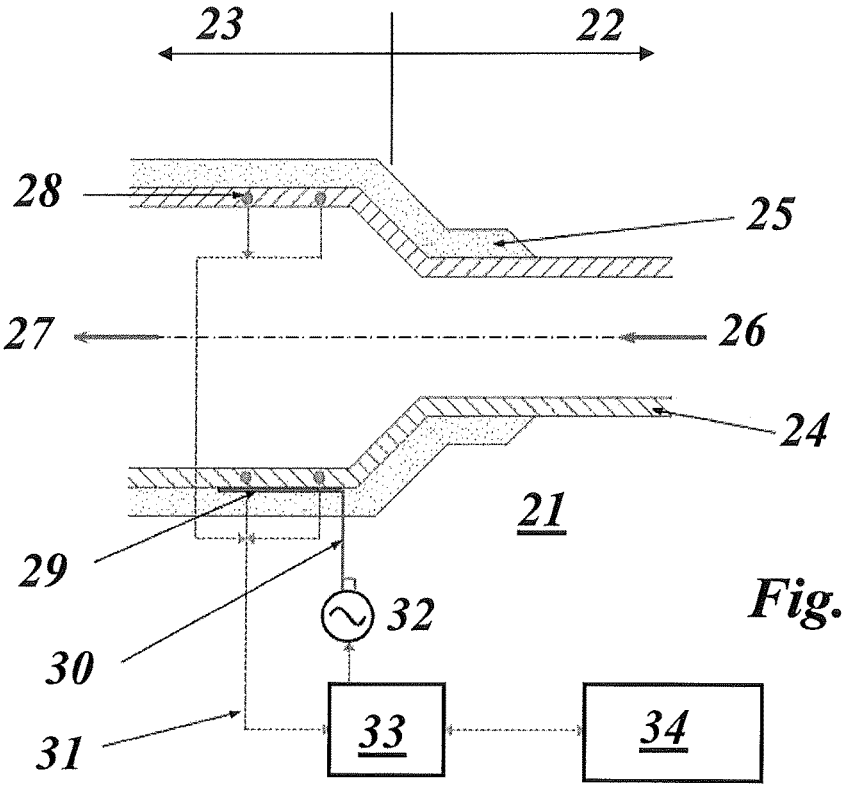
FIG. 2 shows a simplified control scheme for a turbo machine according to an embodiment of the invention.

The main components of a typical embodiment of the system can be seen in FIG. 2. The system shown in FIG. 2 is associated with a gas turbine (GT) enclosure 21, which comprises an axially extending compressor housing 22 followed by a combustor and turbine housing 23. All housings have a metal casing 24. Hot parts are enclosed by a thermal insulation 25. The air passing through the housing enters at air inlet 26 and exits at air outlet 27. The thermal equalization means comprises heating cables 29 arranged at the lower part of the thermally insulated combustor and turbine housing 23. The individual heating cables 29 are supplied with electrical power by a suitable power supply unit 32, which is controlled by a control unit 33.

Control unit 33 receives temperature signals from a plurality of temperature measuring points 28 distributed at the upper as well as the lower part of the thermally insulated combustor and turbine housing 23. A data storage unit 34 is connected to control unit 33 to store temperature data as well as feed control unit 33 with stored data or parameters.

Application of the system shown in FIG. 2 is not limited to gas turbines but is possible to other turbo machine than gas turbines; other embodiments including more or less parts than shown in FIG. 2 are also possible.

Figure 3:
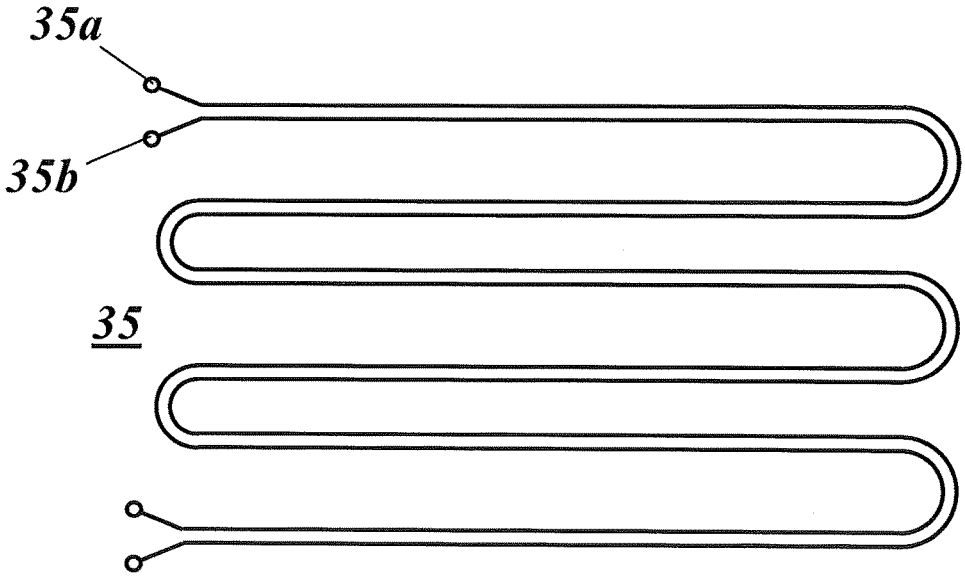
FIG. 3 shows an example of a redundant heating module used in a turbo machine according to the invention.

One of the main features of the system of FIG. 2 is redundancy. As shown in FIG. 3 the heating system uses on the turbo machine heating modules 35 comprising two similar redundant lines 35*a* and 35*b*, which are running in parallel along each other. During normal operation, when both lines 35*a* and 35*b* are working well, both lines shall receive half of the nominal power. If one of the lines 35*a* and 35*b* gets broken, the other line shall be operated with full power to compensate for the loss of one line.

Figure 4:
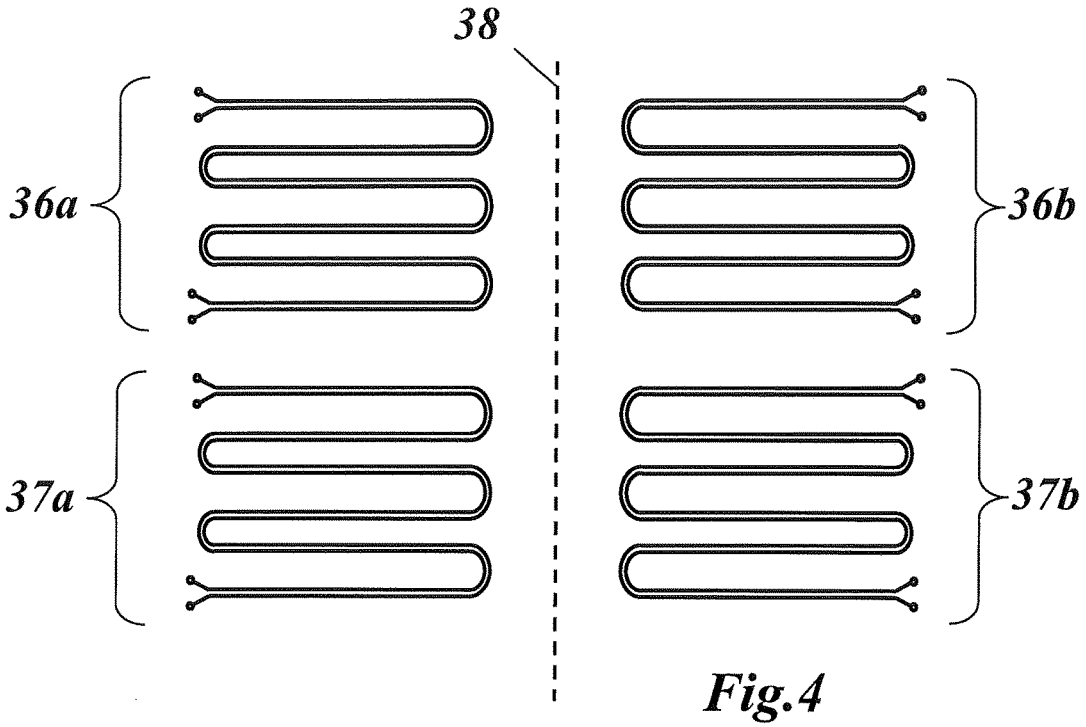
FIG. 4 shows an exemplary symmetric arrangement of a plurality of heating modules on both sides of a vertical symmetry plane in a turbo machine according to the invention.

Furthermore, particular attention is paid to a symmetric operation by the control unit 33: As shown in the example of FIG. 4, heating (element) modules 36*a,b* and 37*a,b* are arranged symmetrical to a vertical plane 38 going through the centreline or machine axis 20 of the engine. In order to avoid the generation of non-desired casing temperature differences, a heating (element) module has to be shut down by the control unit 33 if its symmetric counterpart (on the other side of the symmetry plane 38) is shut down (e.g. because of cable damage).

Figure 5:
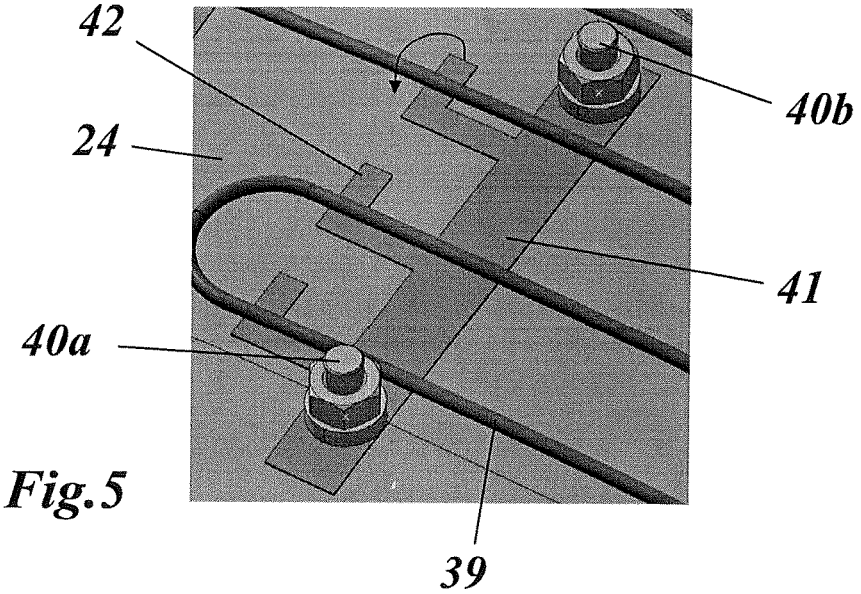
FIG. 5 shows the fixation of the heating cables on the casing according to an embodiment of the invention.

According to FIG. 5, the single heating cables 39 are fixed on the metal casing 24 by holding strips 41, which are placed between the metal casing 24 and the heating cables 39. These holding strips 41 are fixed on the metal casing 24 by bolts 40*a* and 40*b* being welded on the casing. They hold the heating cables 39 with small metal hooks, which are provided by bending small hook elements 42 of the holding strips 41 around the respective heating cable 39. This fixing scheme allows a more stable installation and easier assembly, along with improved heat transfer. In addition, the holding strips 41 could be equipped with pretension means, e.g. by springs.

As shown in FIG. 6, a small bend 43 may be introduced into every cable segment between two holding strips 41*a* and 41*b* to prevent the tearing of the metal hooks by thermal expansion of the heating cables 39. The thermal expansion of the heating cables 39 is expected to be ≈7 mm/m. The cables can be bent in the direction normal to the surface of the casing or tangentially to the casing, i.e. along the surface of the casing.

Another advantageous design feature is related to an instrumentation to measure and monitor the maximum temperature of the heating cables 39. These temperature measurements enable the protection of the system from overheating. The measured cable segment is converted into an artificial "hotspot" to make sure that the hottest cable temperature is measured. However, as an alternative, validated wire resistance measurements can also be used.

Figure 1:
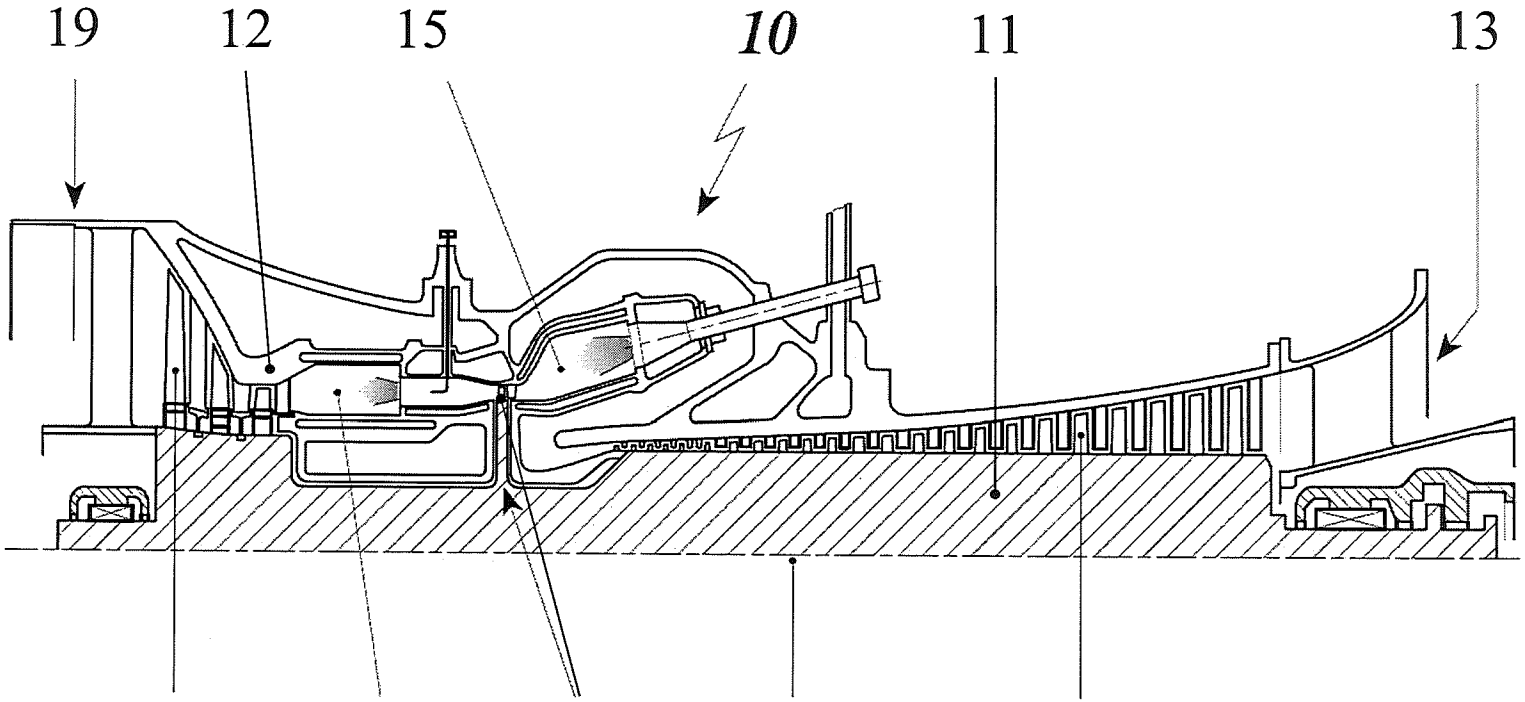
FIG. 1 shows in a perspective view an example of a turbo machine in form of a gas turbine of the applicant of type GT24, respectively GT26 (with sequential combustion)

The maximum temperature monitoring is required for safety reasons: The maximum allowed temperature of the heating cables 39 cannot be higher than the maximum design temperature of the casing. For a gas turbine of the GT24 and GT26 type (see FIG. 1) this temperature is 450° C. This way the outer insulation needs not to be redesigned, and its surface can be touched by a person. Overheated cables can only be turned on again when they are colder than 400° C.

As mentioned above, the design introduces one artificial hot spot for each heating cable 39 used. The hot spot is created by leading the heating cable 39 through a (closed) thermocouple box 44 (FIGS. 7*a* and *b*) and covering the thermocouple box 44 with a thin insulation cloth 48 (FIG. 7*b*). Each thermocouple box 44 has an upper part 45 and a lower part 46 and has three redundant thermocouples 47, which are evaluated by control unit 33 with a 2-out-of-3 logic.

In addition, the system may be equipped with monitoring devices (not shown in FIG. 2) to measure the electric properties of the system (applied power, current, voltage, resistance, etc.). There are two main reasons to apply such electric current monitoring:

identifying broken lines: to prevent current passing on them and to turn their symmetric counterparts off, power compensation: as the cables are heating up their power drops with the same voltage applied on their terminals. With current/resistance measurements the applied voltage can be compensated to get constant power on the heating cables.

When certain standard heating cable modules, e.g. with a standard cable length of 25 m, will be used, it may become possible to use these electric measurements to infer the temperature of the cables. By introducing an extra safety margin to the shutdown cable temperature, this may be used to substitute the (more expensive) thermocouple boxes 44.

The system shown in FIG. 2 can be controlled automatically by taking into account not only the actual measured values of the temperatures and/or electrical parameters but also adjustable parameters and/or stored data as well (data storage unit 34). Operation parameters can be for example overpower ratio or forced shutdown signal, while stored data in the data storage unit 34 can be for example the past states of the system from which trends can be calculated.

In addition, inputs from clearance sensors placed in the machine (e.g. capacitive or optical) can also be used by the control logic of control unit 33.

The trace heating system described so far can be assembled with or without special attention paid for improved heat transfer from the heating cables 39 to the surface of metal casing 24. Heat transfer can be improved by introducing heat bridges by thermal liquid, grooving of the casing, soldering of the cables, metal cover, embedding the cables into the casing, covering the insulation with reflective material, etc. . . . .

In this application, several parts are described as 'upper' or 'lower'. This refers to their position when they are in use in an installed turbo machine.

LIST OF REFERENCE NUMERALS

10 gas turbine (GT, e.g. GT24 and GT26)
11 rotor
12 (inner) casing
13 air intake
14 compressor
15 combustor (e.g. a combustion chamber with an EV burner)
16 turbine (HP)
17 combustor (e.g. a combustion chamber with a SEV burner)
18 turbine (LP)
19 exhaust gas outlet
20 machine axis
21 GT enclosure
22 compressor housing
23 combustor and turbine housing
24 metal casing
25 thermal insulation
26 air inlet
27 air outlet
28 temperature measuring point
29,39 heating cable
30 power line
31 data line
32 power supply unit
33 control unit
34 data storage unit
35 heating module (redundant)
35*a*,*b* redundant line
36*a*,*b* heating module
37*a*,*b* heating module
38 vertical symmetry plane
40*a*,*b* bolt (welded)
41 holding strip
41*a*,*b* holding strip
42 hook element
43 bend
44 thermocouple box
45 upper part
46 lower part
47 thermocouple
48 thermal insulation

The invention claimed is:

1. A turbo machine configured as a gas turbine, comprising:

a rotor, which rotates about a horizontal machine axis, and which is enclosed by a coaxial enclosure having a metal casing;

an electrical heating system provided on the lower half of said metal casing, wherein said heating system is configured as a redundant system, wherein said heating system comprises at least one electrical heating module with two similar redundant lines running in parallel alongside each other, and wherein said heating system includes at least one heating cable and measuring means for measuring temperatures and/or electrical properties within said heating system including at least a temperature of said at least one heating cable.

2. The turbo machine as claimed in claim 1, wherein said at least one heating module is connected to a power supply unit such that either each of said redundant lines is supplied with 50% of the electrical power supplied to said heating module from the power supply unit or only one of said redundant lines is supplied with 100% of said electrical power.

3. The turbo machine as claimed in claim 1, wherein said measuring means is configured as a redundant measuring means.

4. The turbo machine as claimed in claim 3, wherein said at least one heating cable is attached to said metal casing, and said measuring means comprises at least one thermocouple box attached to said at least one heating cable to measure the temperature of said at least one heating cable.

5. The turbo machine as claimed in claim 4, wherein said at least one thermocouple box encloses a section of said at least one heating cable at a predetermined place of said at least one heating cable, that said at least one heating cable runs through said thermocouple box between an upper part and a lower part of said thermocouple box, and that at least three thermocouples for measuring the temperature of said thermocouple box are attached to said thermocouple box.

6. A method for operating a turbo machine according to claim 5, wherein said at least one thermocouple box creates an artificial hot spot at said heating cable, and that said three thermocouples attached to said thermocouple box are evaluated by a control unit with a 2-out-of-3 logic.

7. The turbo machine as claimed in claim 4, wherein said at least one thermocouple box is covered with a thermal insulation in order to increase the temperature of the thermocouple box.

8. The turbo machine as claimed in claim 1, wherein said at least one heating cable, which is attached to said metal casing by means of metal holding strips.

9. The turbo machine as claimed in claim 8, wherein said metal holding strips are placed between said metal casing and said at least one heating cable and hold said heating cable by means of hook elements.

10. The turbo machine as claimed in claim 9, wherein said at least one heating cable is provided with a bend between two distant holdings strips holding said heating cable.

11. The turbo machine as claimed in claim 1, wherein a plurality of heating modules are symmetrically arranged on said metal casing with regard to a vertical symmetry plane through the machine axis, and that said heating modules are individually and controllably supplied with electric power by means of a power supply unit.

12. A method for operating a turbo machine according to claim 11, wherein a heating module on one side of said vertical symmetry plane is turned off when its symmetric counterpart on the other side of said vertical symmetry plane fails.

13. A method for operating a turbo machine according to claim 11, wherein in case of an asymmetric cool-down with respect to said vertical symmetry plane the heating system is powered asymmetrically to counter said temperature asymmetry.

14. A method for operating a turbo machine according to claim 1, wherein a control unit within said heating system decides on the electrical power supplied to said heating system based on measurements of the temperature of the metal casing and/or the clearance of the machine and/or electric parameters of the heating system and/or operating parameters of the turbo machine.

* * * * *